US005448934A

United States Patent [19]

Boldrini et al.

[11] Patent Number: 5,448,934

[45] Date of Patent: Sep. 12, 1995

[54] STRIP MATERIAL AUTOMATIC CHANGE-OVER METHOD AND DEVICE

[75] Inventors: Fulvio Boldrini, Ferrara; Giuliano Corazza, Casalecchio Di Reno, both of Italy

[73] Assignee: G.D. Societa' Per Azioni, Bologna, Italy

[21] Appl. No.: 120,903

[22] Filed: Sep. 14, 1993

[30] Foreign Application Priority Data

Sep. 15, 1992 [IT] Italy ..... BO92A0320

[51] Int. Cl.[6] ..... B26D 3/00; B65B 41/10

[52] U.S. Cl. ..... 83/42; 83/367; 83/365; 83/650; 53/389.2; 53/389.4; 53/168

[58] Field of Search ..... 53/389.2, 389.3, 389.4, 53/168; 83/367, 365, 650, 42; 156/502, 159, 157; 270/52

[56] References Cited

U.S. PATENT DOCUMENTS

| | | | |
|---|---|---|---|
| 3,983,774 | 10/1976 | Seragnoli | 53/389.4 |
| 4,467,589 | 8/1984 | van Maanen | 53/389.4 |
| 4,534,253 | 8/1985 | Seragnoli . | |
| 4,541,221 | 9/1985 | Seragnoli | 53/389.4 |
| 4,972,743 | 11/1990 | Nojima | 83/367 |

*Primary Examiner*—John Sipos
*Assistant Examiner*—Rodney A. Butler
*Attorney, Agent, or Firm*—Michael N. Meller

[57] ABSTRACT

An automatic change-over method and device for strip material in which a new strip is timed in relation to the end portion of a run-out strip fed by traction rollers along an unwinding path, by feeding a portion of the new strip along the unwinding path and arresting it against a stop element; removing the stop element to permit the new strip to be fed along the unwinding path; and, at the same time, connecting the new strip and the run-out strip by friction, in response to a phase signal emitted by a run-out strip.

3 Claims, 1 Drawing Sheet

STRIP MATERIAL AUTOMATIC CHANGE-OVER METHOD AND DEVICE

BACKGROUND OF THE INVENTION

The present invention relates to an automatic change-over method for strip material.

In particular, the present invention relates to an automatic change-over method for strip material fed by a traction unit along a given path, the traction unit being located along the path and upstream, in the traveling direction of the strip material, from a cutting station where the strip material is cut transversely into pieces and along any cutting line.

The present invention is especially suitable for use on production machines employing strip material, e.g. semi-rigid paper, and particularly cigarette packing machines to which the following description refers purely by way of example.

Italian Patent Application n. 3426A/90, to which full reference is made herein in the interest of full disclosure, relates to a strip material automatic change-over device whereby the end of a new strip is connected to a first run-out strip fed along an unwinding path by the traction roller unit of a user packing machine. The first strip is fed by the traction unit rollers to a cutting station located along said path and where the first strip is cut into pieces of desired shape along not necessarily straight cutting lines.

According to the above patent, a given end portion of the new strip is fed over and on to the first strip by which the new strip is drawn by friction through the traction unit and from there to the cutting station. When a cut is made in the overlapping portion of the two strips, the first cut in the new strip frequently corresponds with its end edge. Since the end edge of the new strip is normally straight and perpendicular to the longitudinal axis of the strip, and since, as already stated, the cutting line, as opposed to being straight and parallel to the end edge of the new strip, is frequently so shaped as to intersect the end edge at various points, the cut made in the overlapping portion of the two strips normally results in the formation of relatively small scraps which drop down into the bottom of the packing machine and require frequent stoppage of the machine for their removal.

SUMMARY OF THE INVENTION

It is an object of the present invention to provide a method of replacing a run-out strip, subsequently cut into pieces, with a new strip, and designed to overcome the aforementioned drawback.

According to the present invention, there is provided an automatic change-over method for strip material fed by a traction unit along a given path, the traction unit being located along said path and upstream, in the traveling direction of the strip material, from a cutting station where the strip material is cut transversely into pieces and along a cutting line of any shape; the strip material comprising a first run-off strip and a second new strip; the pieces being fed successively along said path downstream from the cutting station; and the method comprising a stage consisting in feeding a front end portion of the second strip along a portion of said path upstream from the traction unit; characterized by the fact that it comprises further stages consisting in arresting said end portion with its end edge in a given position upstream from the traction unit; determining, via sensor means, the feed phase of said pieces along said path downstream from the cutting station; feeding said end portion, together with the first strip, through the traction unit, in response to a phase signal emitted by said sensor means, and in such a manner as to feed said end edge through the cutting station in a given position in relation to the rear edge, in said traveling direction, of the foregoing piece.

According to a preferred embodiment of the above method, said end portion of the second strip is fed over the first run-off strip, and is fed along said path until it is arrested against movable stop means upstream from the traction unit and in contact with the first strip; said movable stop means being removed from said path in response to said phase signal.

The second strip is preferably fed, together with the first strip, through the traction unit by friction, by compressing the end portion of the second strip on to the first strip in conjunction with removal of said movable stop means.

The present invention also relates to an automatic change-over device for strip material.

According to the present invention, there is provided an automatic change-over device for strip material, the device comprising a traction unit for feeding the strip material along a given path; cutting means for cutting the strip material transversely into pieces and along a cutting line of any shape, the cutting means being located along said path and downstream from the traction unit in the traveling direction of the strip material; and means for feeding said pieces successively along said path downstream from said cutting means; the strip material comprising a first run-off strip and a second new strip; and first push means being provided for feeding a front end portion of the second strip along a portion of said path upstream from the traction unit; characterized by the fact that it also comprises stop means for arresting said end portion with its end edge in a given position upstream from the traction unit; sensor means for determining the feed phase of said pieces along said path downstream from the cutting means; and second push means for feeding said end portion, together with the first strip, through the traction unit, in response to a phase signal emitted by said sensor means, and in such a manner as to feed said end edge through the cutting means in a given position in relation to the rear edge, in said traveling direction, of the foregoing piece.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 2:
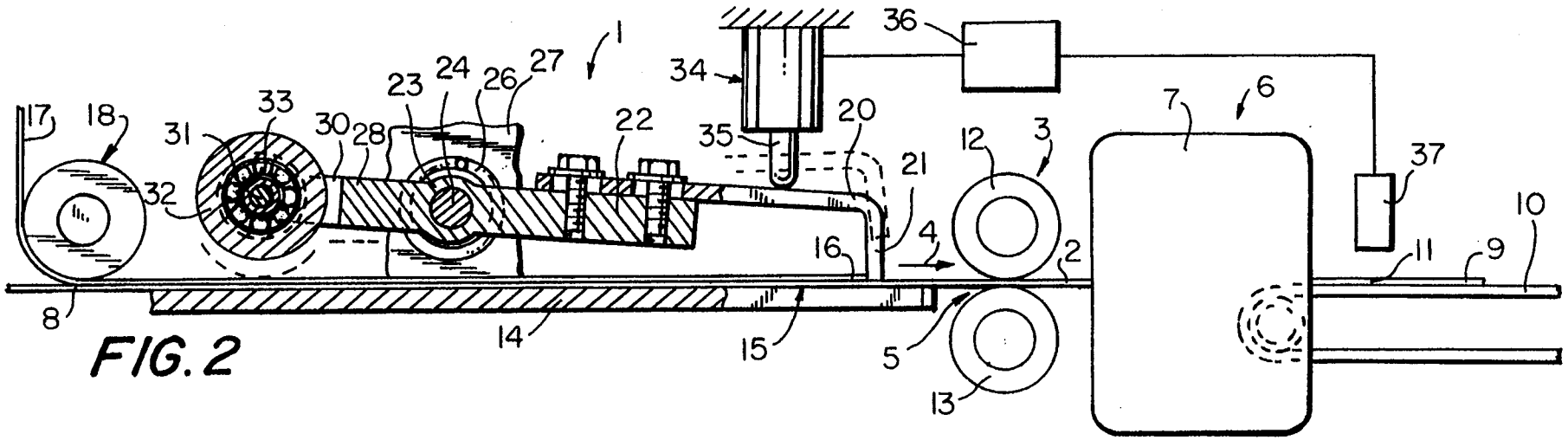
FIG. 2 shows a section along line I—I in FIG. 1.
Figure 1:
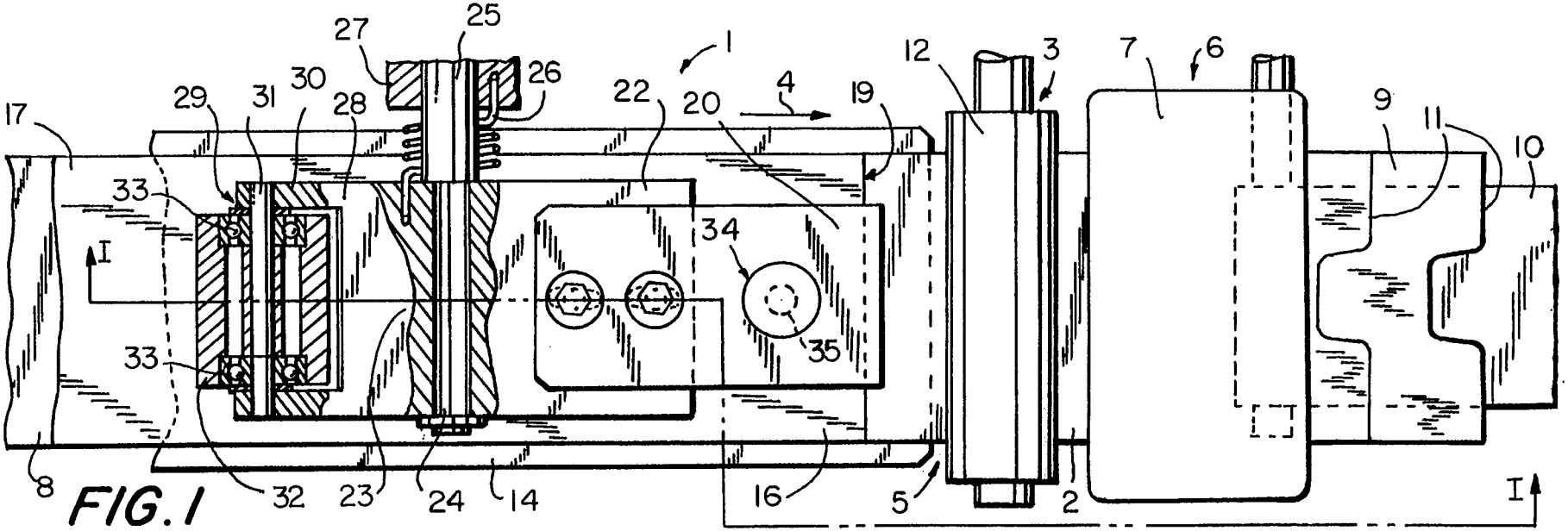
FIG. 1 shows a partially sectioned plan view, with parts removed for clarity, of a preferred embodiment of the device according to the present invention.

Number 1 in the accompanying drawings indicates an automatic change-over device for strip material 2 fed to a production machine (not shown) consisting in the example shown of a cigarette packing machine. Device 1 comprises a traction unit 3 for feeding strip material 2 in a given direction 4 and along a given path 5 extending through unit 3 and a cutting station 6. Station 6 comprises a known cutting device 7 located downstream from unit 3 in direction 4, and which is moved by known actuating means (not shown) so as to successively engage strip material 2. In the example shown, material 2 comprises a strip 8 of semi-rigid material, such as cardboard, which is cut transversely by device 7 into a succession of pieces 9 which are removed successively from station 6 by a conveyor 10 traveling in direction 4.

In the example shown, each piece 9, when folded, constitutes the front collar of a rigid hinged-lid cigarette packet (not shown), and is defined at its opposite axial ends by two non-straight cutting lines 11 formed by cutting device 7.

In the example shown, traction unit 3 consists of a pair of pressure rollers 12 and 13, the first located over the second, for exerting pressure on strip 8; and cutting station 6 is located along path 5, on the opposite side of unit 3 to a plate 14 defining a sliding surface 15 for strip 8 and a supporting surface for the front portion 16 of a further strip 17 forming part of strip material 2.

During normal forward feed of strip 8 by unit 3, front portion 16 is fed over and on to strip 8 by a known thrust roller device 18, and is arrested with its free front end edge 19, normally a straight edge perpendicular to direction 4, contacting a stop element or tooth 20. As shown in FIG. 2, stop element 20 presents a substantially L-shaped axial section, and comprises an arm 21 extending substantially perpendicular to surface 15 and having its free end facing a surface portion of strip 8 opposite that facing surface 15 and adjacent to unit 3. At the opposite end to arm 21, element 20 is connected integral with arm 22 of a rocker arm 23 pivoting on a shaft 24 perpendicular to direction 4 and parallel to surface 15, so as to rotate anticlockwise (in FIG. 2) about axis 25 of shaft 24, i.e. in such a direction as to withdraw element 20 from surface 15, by virtue of a helical spring 26 wound about axis 25 and loaded between rocker arm 23 and a body 27 supporting shaft 24.

Rocker arm 23 also comprises a second arm 28, the free end portion 29 of which consists of a fork 30 supporting a pin 31 parallel to axis 25 and in turn supporting a thrust roller 32 mounted for rotation on pin 31 via the interposition of two bearings 33.

Rocker arm 23 is maintained with arm 21 of stop element 20 in the lowered position, substantially contacting the opposite surface of strip 8 to that contacting surface 15, by an actuator 34 located over element 20 and having an output rod 35 substantially perpendicular to surface 15 and designed to cooperate with the upper lateral surface of element 20. Upon receiving an enabling signal emitted by control system 36, actuator 34 moves rod 35 from the normal extracted position, wherein rod 35 cooperates with element 20 for maintaining arm 21 in said lowered position, to a withdrawn position enabling rocker arm 23 to be rotated about axis 25 by spring 26, so as to free the front end of strip 17 and, at the same time, bring the periphery of thrust roller 32 into contact with the opposite surface of front portion 16 of strip 17 to that contacting strip 8, and so press strips 8 and 17 against plate 14 and render strips 8 and 17 integral with each other by friction.

Said enabling signal is emitted by system 36 in response to system 36 receiving a phase signal emitted by a sensor 37 for detecting the passage of a cutting line 11 through a given point on path 5 downstream from cutting station 6. Alternatively, according to a variation not shown, sensor 37 is connected with cutting device 7 or any mechanical device activating device 7.

Under normal operating conditions, strip 8 is fed by traction unit 3 along path 5 in direction 4 and through cutting station 6, where strip material 2 is cut by device 7 into pieces 9, which are fed by conveyor 10 to the packing machine.

As strip 8 is about to run out, strip 17 is fed forward by thrust device 18 and arrested with end edge 19 of front portion 16 contacting arm 21 of stop element 20.

Following arrest of strip 17, and before strip 8 runs out entirely, a cutting line 11 is detected by sensor 37; a phase signal is supplied to and processed by control system 36; a further signal is emitted by system 36 for enabling actuator 34; and, upon receiving the enabling signal, actuator 34 detaches output rod 35 from stop element 20.

When output rod 35 is withdrawn, the thrust exerted by spring 26 rotates rocker arm 23 anticlockwise (in FIG. 2), so as to withdraw arm 21 of stop element 20 from strip material 2 and, substantially simultaneously, press roller 32 on to strip 17, so as to press strip 17 on to run-out strip 8 and so ensure both are fed synchronously to cutting station 6.

The advantages of the present invention will be clear from the foregoing description. In particular, it provides for synchronizing, or rather, achieving a predetermined distance between end edge 19 of the new strip 17 and the last cutting line 11 in run-out strip 8, by regulating supply of the control signal emitted by system 36 in relation to the phase signal of sensor 37.

Moreover, the embodiment of device 1 described above is highly straightforward in design, thus enabling the object of the present invention to be achieved extremely cheaply.

We claim:

1. An automatic change-over method for strip material (2) fed by a traction unit (3) along a given path (5), the traction unit (3) being located along said path (5) and upstream, in the traveling direction (4) of the strip material (2), from a cutting station (6) where the strip material (2) is cut transversely into pieces (9) and along a cutting line (11) of any shape; the strip material (2) comprising a first run-off strip (8) and a second new strip (17); the pieces (9) being fed successively along said path (5) downstream from the cutting station (6); and the method comprising feeding a front end portion (16) of the second strip (17) along a portion of said path (5) upstream from the traction unit (3); arresting said end portion (16) with its end edge (19) in a given position upstream from the traction unit (3); determining, via sensor means (37), the feed phase of said pieces (9) along said path (5) downstream from the cutting station (6); feeding said end portion (16), together with the first Strip (8), through the traction unit (3), in response to a phase signal emitted by said sensor means (37), and further characterized by the fact that said end portion (16) of the second strip (17) is fed over and into contact with the first run-off strip (8) and along said path (5) until it is arrested against movable stop means (20) upstream from the traction unit (3); said movable stop means (20) being removed from said path (5) in response to said phase signal.

2. (Amended) An automatic change-over device for strip material (2), the device comprising a traction unit (3) for feeding the strip material (2) along a given path cutting means (7) for cutting the strip material (2) transversely into pieces (9) and along a cutting line (11) of any shape, the cutting means (7) being located along said path (5) and downstream from the traction unit (3) in the traveling direction (4) of the strip material (2); and means (10) for feeding said pieces (9) successively along said path (5) downstream from said cutting means (7); the strip material (2) comprising a first run-off strip (8) and a second new strip (17); and first push means (18) being provided for feeding front end portion (16) of the second strip (17) along a portion of said path (5) upstream from the traction unit (3); characterized by the fact that it also comprises stop means (20) for arresting said end portion (16) with its end edge (19) in a given position upstream from the traction unit (3); sensor means (37) for determining the feed phase of said pieces (9) along said path (5) downstream from the cutting means (7); and second push means (32) for maintaining said end portion (16), in registration over the first strip (8) as they pass through the traction unit (3), in response to a phase signal emitted by said sensor means (37), and further characterized by the fact that said stop means (20) comprises a stop element (20) having an arm (21) substantially perpendicular to the surface (15) of a plate (14) over which the strip material (2) slides, and which is located beneath said path (5) and upstream from the traction unit (3); said arm (21) also being substantially parallel to the end edge (19) of the second strip (17).

3. A device as claimed in claim 2, characterized by the fact that said stop means (20) are fitted rigidly to a first arm (22) of a rocker arm (23) pivoting on a shaft (24); the rocker arm (23) also comprising a second arm (28) fitted with said second push means (32), which consist of a push roller (32) mounted in idle manner on a Din (31) fitted rigidly to said second arm (28).

* * * * *